US008857809B2

(12) United States Patent
Toyooka et al.

(10) Patent No.: US 8,857,809 B2
(45) Date of Patent: Oct. 14, 2014

(54) SHEET SEPARATION/CONVEYANCE DEVICE AND IMAGE FORMING APPARATUS INCORPORATING SAME

(71) Applicants: Tsugunao Toyooka, Kanagawa (JP); Manabu Nonaka, Kanagawa (JP); Yoshikuni Ishikawa, Tokyo (JP); Satoshi Kuno, Tokyo (JP)

(72) Inventors: Tsugunao Toyooka, Kanagawa (JP); Manabu Nonaka, Kanagawa (JP); Yoshikuni Ishikawa, Tokyo (JP); Satoshi Kuno, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/016,620

(22) Filed: Sep. 3, 2013

(65) Prior Publication Data

US 2014/0070479 A1 Mar. 13, 2014

(30) Foreign Application Priority Data

Sep. 7, 2012 (JP) ..... 2012-197318

(51) Int. Cl.
*B65H 3/16* (2006.01)
*B65H 3/18* (2006.01)

(52) U.S. Cl.
CPC ..... *B65H 3/18* (2013.01)
USPC ..... 271/18.1; 271/34

(58) Field of Classification Search
USPC ..... 271/18.1, 18.2, 34, 901
See application file for complete search history.

(56) References Cited

U.S. PATENT DOCUMENTS

| | | | | |
|---|---|---|---|---|
| 5,322,269 | A * | 6/1994 | Fukube et al. | 271/18.1 |
| 8,083,226 | B2 * | 12/2011 | Terada | 271/901 |
| 2010/0296851 | A1 | 11/2010 | Toyooka et al. | |
| 2011/0024971 | A1 | 2/2011 | Toyooka et al. | |
| 2011/0052227 | A1 | 3/2011 | Toyooka et al. | |
| 2011/0062651 | A1 | 3/2011 | Higaki et al. | |
| 2011/0062655 | A1 | 3/2011 | Togashi et al. | |
| 2011/0121506 | A1 | 5/2011 | Ishikawa et al. | |
| 2011/0127711 | A1 | 6/2011 | Takahashi et al. | |
| 2011/0204557 | A1 | 8/2011 | Ishikawa et al. | |
| 2011/0204558 | A1 | 8/2011 | Takahashi et al. | |
| 2012/0061903 | A1 * | 3/2012 | Eguchi et al. | 271/18.1 |
| 2012/0061904 | A1 | 3/2012 | Higaki et al. | |
| 2012/0170960 | A1 | 7/2012 | Nishida et al. | |
| 2012/0228817 | A1 | 9/2012 | Kobayashi et al. | |
| 2012/0230745 | A1 | 9/2012 | Kobayashi et al. | |
| 2012/0235346 | A1 | 9/2012 | Ikeda et al. | |
| 2013/0113869 | A1 | 5/2013 | Kobayashi et al. | |
| 2013/0161894 | A1 | 6/2013 | Ishikawa et al. | |
| 2013/0234385 | A1 * | 9/2013 | Suzuki | 271/18.1 |

FOREIGN PATENT DOCUMENTS

| | | |
|---|---|---|
| JP | 5-139548 | 6/1993 |
| JP | 2003-237960 | 8/2003 |

* cited by examiner

*Primary Examiner* — Gerald McClain
(74) *Attorney, Agent, or Firm* — Harness, Dickey & Pierce, P.L.C.

(57) ABSTRACT

A sheet separation/conveyance device that is included in an image forming apparatus includes an attraction/separation unit including an endless belt on which a region of attraction and a region of no attraction that divides the region of attraction are aligned in a sheet conveying direction, the endless belt configured to hold an uppermost sheet placed on top of a sheet stack contained in an image forming apparatus by using electrostatic attraction, a charger configured to charge a surface of the endless belt, the charger including an electrode configured to contact the surface of the endless belt due to a supply of a voltage and a detector configured to detect a charged condition on the surface of the endless belt based on a detection result obtained when the electrode contacts the endless belt, and a sheet conveying unit configured to convey the uppermost sheet held by the electrostatic attraction.

6 Claims, 10 Drawing Sheets

SHEET SEPARATION/CONVEYANCE DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2012-197318, filed on Sep. 7, 2012 in the Japan Patent Office, the entire disclosure of which is hereby incorporated by reference herein.

BACKGROUND

1. Technical Field

Embodiments of the present invention relates to a sheet separation/conveyance device for separating and conveying a sheet such as an original document and a recording medium, and an image forming apparatus including the sheet separation/conveyance device.

2. Related Art

Image forming apparatuses include printers, copiers, facsimile machines, and multifunctional digital machine including at least two functions of the printers, the copiers, and the facsimile machines. These image forming apparatuses feed a sheet of paper including an original document, a recording paper, a transfer sheet, a printing sheet and the like from a sheet container. As the sheet travels in an image forming device, an image is formed on a surface of the sheet, and then the sheet is discharged from the image forming apparatus. The sheet container includes a sheet feeding device and the image forming device includes a sheet conveying device.

Known sheet conveying device employs an electrostatic attraction system including an endless electrostatic attraction belt. A base of the endless electrostatic attraction belt is a belt-shaped flexible insulating member formed by rubber, resin, or the like. Multiple sheet-like electrodes (electrode patterns) are embedded in the base of the endless electrostatic attraction belt. The endless electrostatic attraction belt is wound around multiple rollers to rotate and convey the sheet.

Such an electrostatic attraction system is employed in Japanese Patent Application Publication Nos. JP-05-139548-A and JP-2003-237960-A, for example.

JP-05-139548-A discloses a sheet conveying device that sequentially picks up an uppermost sheet of a sheet stack accumulated in a sheet container of an image forming apparatus. The sheet conveying device applies an alternative charge to a conductive endless belt wound around multiple rollers, so that the belt swings or rotates to contact or nearly contact the accumulated sheet stack. After the uppermost sheet is attracted to and held by the belt, the belt is moved to separate from the sheet stack. By so doing, the sheet is separated from the sheet stack.

Further, a sheet conveying device of the electrostatic attraction system disclosed in JP-2003-237960-A includes a surface potential meter that measures a quantity of electric charge on the belt so as to include a physical property detection unit to detect a physical property of the sheet to be fed, a charge forming unit to form an electric charge on an attraction surface, and a controller to control a quantity of electric charge generated by the charge forming unit and a time of attraction during which a sheet contacts the attraction surface.

However, the conventional sheet conveying device using electrostatic attraction as disclosed in JP-2003-237960-A uses a measuring instrument such as an electrometer on the belt to detect a charged condition such as a quantity of electric charge on the belt. This configuration requests wide space around the belt and causes a large amount of cost.

SUMMARY

The present invention provides an attraction/separation unit, a charger, and a sheet conveying unit. The attraction/separation unit includes an endless belt on which a region of attraction and a region of no attraction that divides the region of attraction are aligned in a sheet conveying direction. The endless belt is configured to hold an uppermost sheet placed on top of a sheet stack contained in an image forming apparatus by using electrostatic attraction. The charger is configured to charge a surface of the endless belt and include an electrode configured to contact the surface of the endless belt due to a supply of a voltage and a detector configured to detect a charged condition on the surface of the endless belt based on a detection result obtained when the electrode contacts the endless belt. The sheet conveying unit is configured to convey the uppermost sheet held by the electrostatic attraction.

Further, the present invention provides an image forming apparatus including an image forming device configured to form an image on a surface of an image carrier, and the above-described separation/conveyance device.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
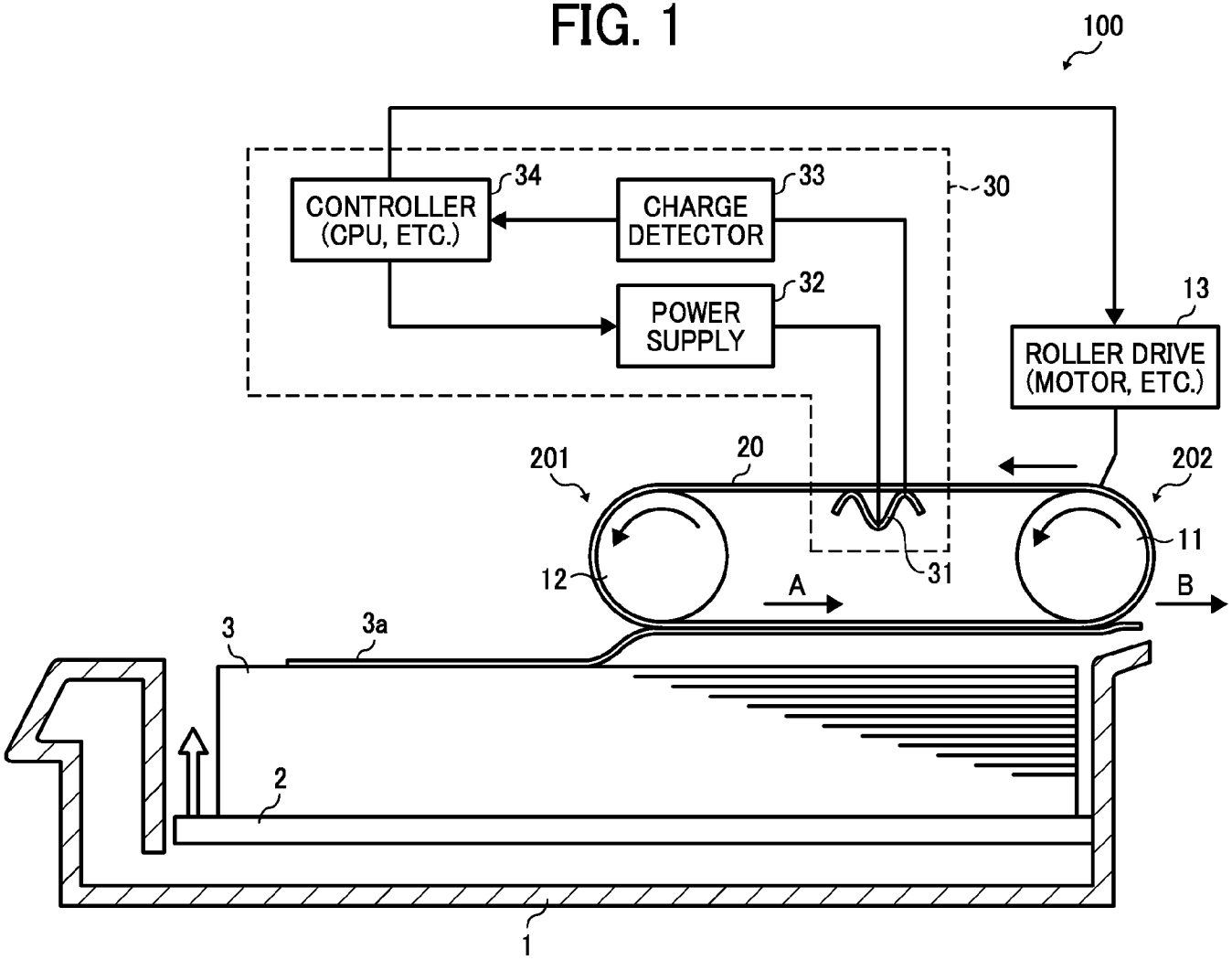
FIG. 1 is a schematic diagram illustrating a partial side view of an image forming apparatus including a sheet separation/conveyance device according to an embodiment of the present invention the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

FIG. 1 is a schematic diagram illustrating a partial side view of an image forming apparatus 100 including a sheet separation/conveyance device 10 according to an embodiment of the present invention.

As illustrated in FIG. 1, the sheet separation/conveyance device 10 according to the present embodiment includes a drive roller 11, a driven roller 12, and an electrostatic attraction belt 20.

The drive roller 11 rotates in a direction indicated by arrow in FIG. 1.

The driven roller 12 rotates with the drive roller 11 in the same direction.

The electrostatic attraction belt 20 functions as a conductive endless belt stretched taut by the drive roller 11 and the driven roller 12. The electrostatic attraction belt 20 has electrode patterns 24 and 25 embedded therein for charging. Details of the electrode patterns 24 and 25 will be described below.

The sheet separation/conveyance device 10 further includes a charger 30 to uniformly charge a surface of the electrostatic attraction belt 20. The charger 30 includes an electrode set for charging 31, a power supply 32, a charged condition detector 33, and a controller 34.

The electrode set for charging 31 is disposed in contact with the surface of the electrostatic attraction belt 20.

The power supply 32 applies high voltage direct current to the electrode set for charging 31.

Of the components included in the charger 30, the charged condition detector 33 and the controller 34 are implemented on a substrate such as a printed circuit board.

The charged condition detector 33 detects a charged condition and its change when the electrode set for charging 31 contacts the electrostatic attraction belt 20 in cooperation with the electrode set for charging 31. To achieve the detection, a measurement instrument such as a voltmeter, a galvanometer, or an ammeter is used.

The controller includes a central processing unit (CPU) and memories such as a random access memory (RAM) and a read-only memory (ROM) to control processes related to detection of charged condition of the electrostatic attraction belt 20.

The electrode set for charging 31 is a part of the charger and is disposed on an under side (an inner circumferential surface) of the electrostatic attraction belt 20 that is an opposite side of a side that to which a sheet 3*a* on the electrostatic attraction belt 20 is attracted, as illustrated in FIG. 1. In FIG. 1, the electrode set for charging 31 is disposed on an upper side of the electrostatic attraction belt 20.

The electrode set for charging 31 is fixedly supported by a non-illustrated supporting member so that two contact portions of the electrode set for charging 31 contacts the surface of the electrostatic attraction belt 20. Details of the shape of the electrode set for charging 31 are described below.

The image forming apparatus 100 further includes a sheet feed tray 1 disposed below the sheet separation/conveyance device 10. The sheet feed tray 1 includes a sheet accommodating plate 2 therein. The sheet accommodating plate 2 can move up and down by a non-illustrated lifting unit. A sheet stack 3 including recording media is placed on the sheet accommodating plate 2. By lifting the sheet accommodating plate 2 in a direction indicated by arrow in FIG. 1, an uppermost sheet 3*a* placed on top of the sheet stack 3 contacts an over side (an outer circumferential surface) of the lower side of the electrostatic attraction belt 20.

With this configuration, the electrostatic attraction belt 20 in cooperation with the charger 30 electrostatically attracts the uppermost sheet 3*a* to the over side thereof. Further, a roller drive unit 13 including a drive circuit and a drive motor drives the drive roller 11 in a direction indicated by an arrow in FIG. 1, so that the electrostatic attraction belt 20 is rotated in a direction indicated by arrow A to convey the uppermost sheet 3*a* that is electrostatically attracted by the electrostatic attraction belt 20 in a direction indicated by arrow B.

In the sheet separation/conveyance device 10 according to the present embodiment, the electrostatic attraction belt 20 forms an attraction/separation unit 201 together with a non-illustrated belt fixing retaining mechanism. Further, the drive roller 11, the driven roller 12, and the roller drive unit 13 form a sheet conveying unit 202.

Nest, a description is given of a configuration of the electrostatic attraction belt 20 with reference to FIGS. 2 and 3.

Figure 2A:
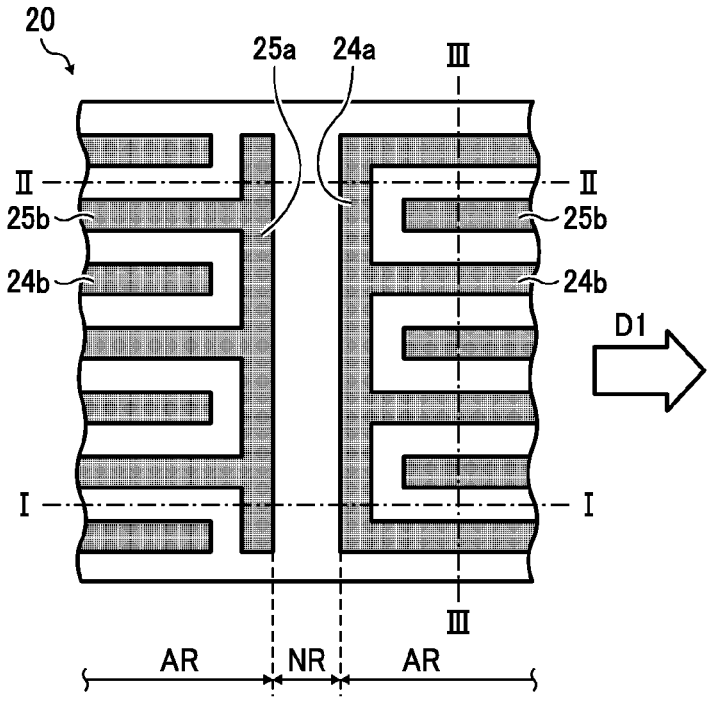
FIG. 2A is a plan view illustrating electrode patterns embedded in an over side (an outer circumferential surface) of an electrostatic attraction belt of the sheet separation/conveyance device of FIG. 1.
Figure 2B:
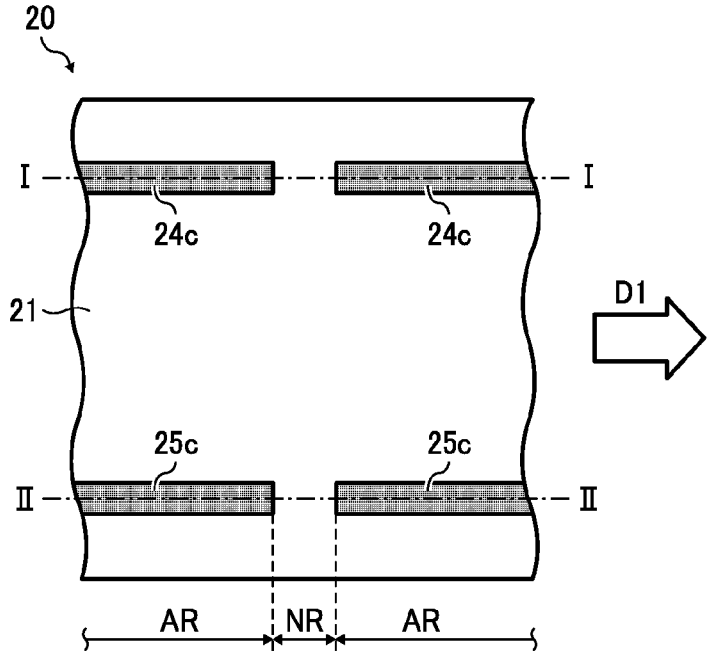
FIG. 2B is a plan view illustrating electrode patterns embedded in an under side (an inner circumferential surface) of the electrostatic attraction belt of the sheet separation/conveyance device of FIG. 1.
Figure 3A:
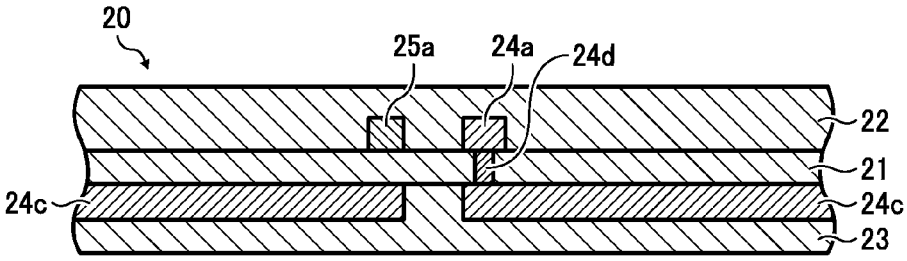
FIG. 3A is a cross-sectional view illustrating a configuration of the electrostatic attraction belt along a line I-I of FIGS. 2A and 2B.
Figure 3B:
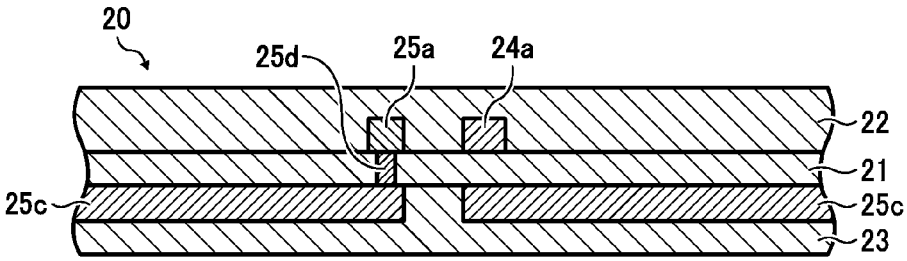
FIG. 3B is a cross-sectional view illustrating a configuration of the electrostatic attraction belt along a line II-II of FIGS. 2A and 2B.
Figure 3C:
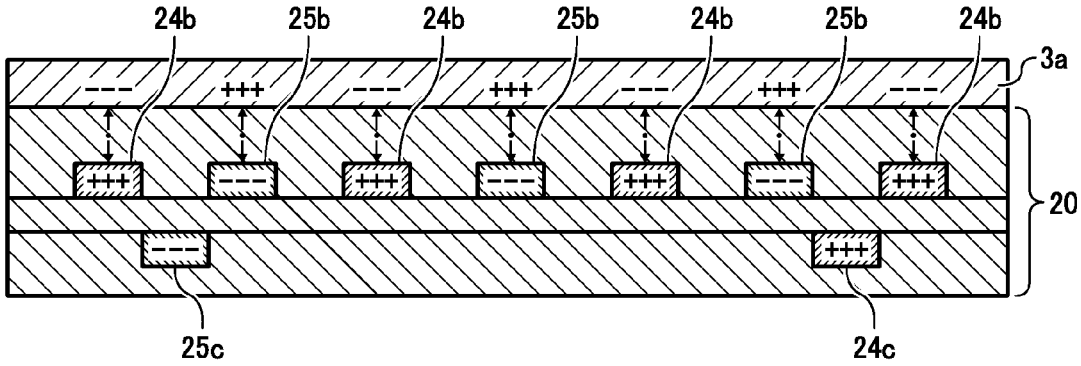
FIG. 3C is a cross-sectional view illustrating a configuration of the electrostatic attraction belt along a line III-III of FIG. 2A.

FIGS. 2A and 2B are diagrams illustrating a part of the electrostatic attraction belt 20. FIG. 2A illustrates the electrode patterns embedded in the over side (the outer circumferential surface) of the electrostatic attraction belt 20. FIG. 2B illustrates electrode patterns embedded in the under side (the inner circumferential surface) of the electrostatic attraction belt 20. FIGS. 3A through 3C are cross-sectional views of the electrostatic attraction belt 20 when the uppermost sheet 3*a* is electrostatically attracted to the electrostatic attraction belt 20. FIG. 3A illustrates a cross-sectional view of a configuration of the electrostatic attraction belt 20 along a line I-I of FIGS. 2A and 2B. FIG. 3B is a cross-sectional view illustrating a configuration of the electrostatic attraction belt 20 along a line II-II of FIGS. 2A and 2B. FIG. 3C is a cross-sectional view illustrating a configuration of the electrostatic attraction belt along a line III-III of FIG. 2A.

As illustrated in FIGS. 2A and 2B, the endless electrostatic attraction belt 20 has a region of attraction AR and a region of no attraction NR. The region of attraction AR extends in a sheet conveying direction that is indicated by arrow D1. The region of no attraction NR divides the region of attraction AR into two sections. No electrode patterns are formed on the regions of no attraction NR on both the over and under sides of the electrostatic attraction belt 20.

In the region of attraction AR on the over side of the electrostatic attraction belt 20, a pair of comb-like electrode patterns is formed as multiple conductive electrodes. Each of the pair of comb-like electrode patterns is charged to a positive polarity or a negative polarity.

The pair of comb-like electrode patterns formed in the region of attraction AR on the over side of the electrostatic attraction belt 20 includes lateral line electrode patterns 24*a* and 25*a* and multiple comb teeth electrode patterns 24*b* and 25*b*. Each of the lateral line electrode patterns 24*a* and 25*a* extends in a lateral direction of the electrostatic attraction belt 20. The comb teeth electrode patterns 24*b* and 25*b* extend from the lateral line part 24*a* and 25*a*, respectively, in the sheet conveying direction of the electrostatic attraction belt 20 and are disposed such alternately with intervals therebetween. For example, one comb teeth electrode pattern 24*b* is disposed between two comb teeth electrode patterns 25*b* adjacent to each other.

In the region of attraction AR on the under side of the electrostatic attraction belt 20, longitudinal line electrode patterns 24*c* and 25*c* extending along both lateral edges of the electrostatic attraction belt 20 in a longitudinal direction thereof.

The lateral line electrode patterns 24*a* and 25*a* and the comb teeth electrode patterns 24*b* and 25*b* on the over side of the electrostatic attraction belt 20 and the longitudinal line electrode patterns 24*c* and 25*c* on the under side of the electrostatic attraction belt 20 interpose a core layer 21 that functions as a base of the electrostatic attraction belt 20 therebetween.

As illustrated in FIGS. 3A through 3C, the lateral line electrode patterns 24*a* and 25*a* and the longitudinal line electrode patterns 24*c* and 25*c* communicate, respectively, via conductive members 24*d* and 25*d*. The conductive members 24*d* and 25*d* are formed through the core layer 21 of the electrostatic attraction belt 20. These electrode patterns 24*a* through 24*c* and 25*a* through 25*c*, which are formed on both sides of the electrostatic attraction belt 20 and interpose the core layer 21 therebetween, are covered by cover layers 22 and 23. The cover layers 22 and 23 include a belt-shaped dielectric material having flexibility such as rubber and resin, which is the same as the core layer 21.

Figure 4:
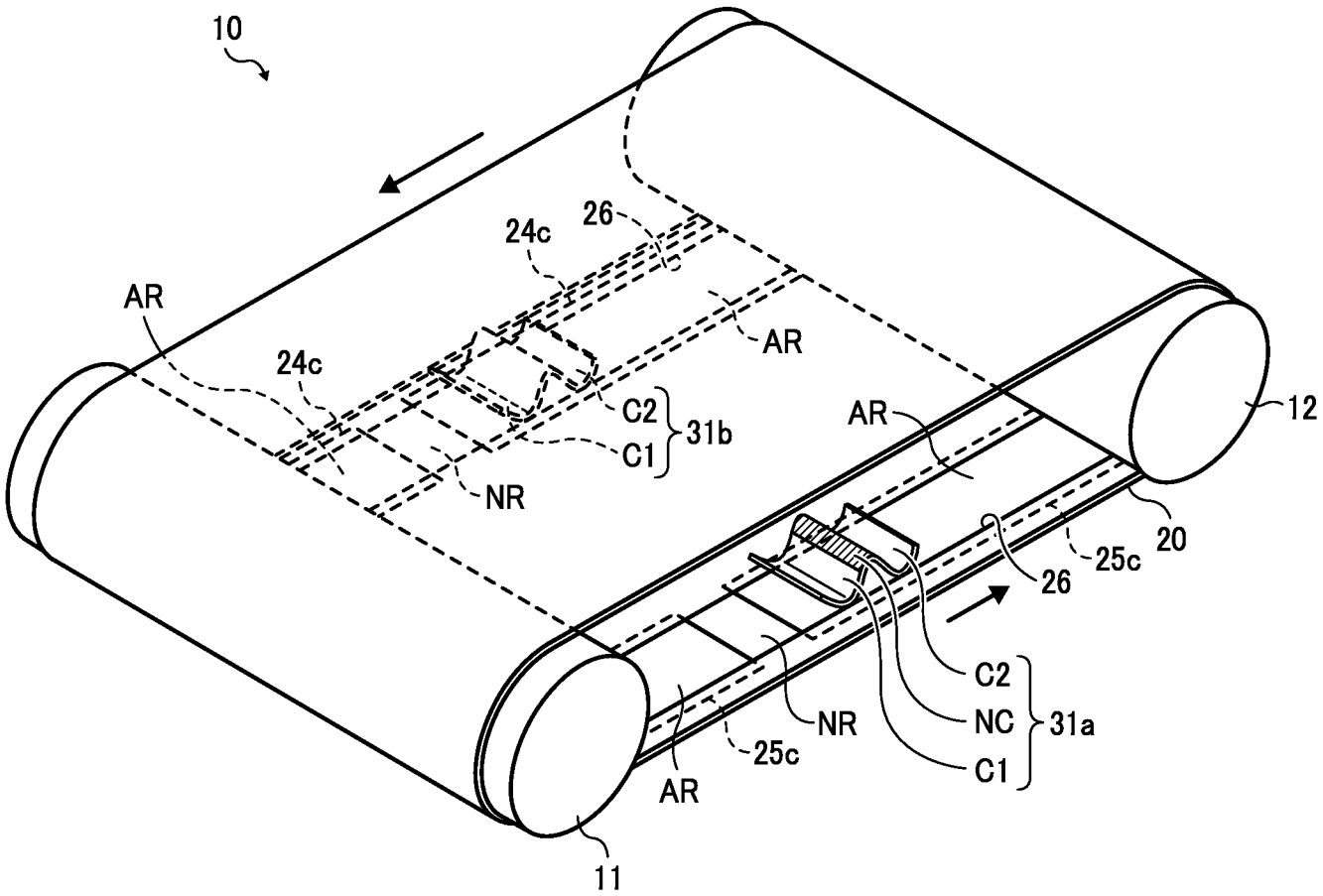
FIG. 4 is a perspective view illustrating a shape and position of an electrode set for charging in the sheet separation/conveyance device.

Further, a slot 26 is provided for supplying electricity on the under side (the inner circumferential surface) of the electrostatic attraction belt 20, along both edge portions over the whole circumference, which is illustrated in FIG. 4. The slot 26 is formed such that the longitudinal line electrode patterns 24*c* and 25*c* are exposed.

By applying an appropriate high voltage to the longitudinal line electrode patterns 24*c* and 25*c* exposed from the slot 26, the lateral line electrode patterns 24*a* and 25*a* and the comb teeth electrode patterns 24*b* and 25*b* on the over and under sides of the electrostatic attraction belt 20 can be charged to a positive polarity or a negative polarity via the conductive members 24*d* and 25*d* in the core layer 21. With this charging, the electrostatic attraction belt 20 can electrostatically attract the uppermost sheet 3*a*.

As illustrated in FIG. 3C, when the electrode patterns on the over side of the electrostatic attraction belt 20, e.g., the comb teeth electrode patterns 24*b* and 25*b* are charged to a positive or negative high voltage (for example, +1 kV and −1 kV), dielectric polarization occurs. At this time, contact of the uppermost sheet 3*a* such as an isolated recording material to the over side of the electrostatic attraction belt 20 causes the polarization, thereby generating a charge having a polarity opposite to the charge of each of the comb teeth electrode patterns 24*b* and 25*b* at a position on the uppermost sheet 3*a* facing each of the comb teeth electrode patterns 24*b* and 25*b*.

The charge having the opposite polarity generates electrostatic attraction between each of the comb teeth electrode patterns 24*b* and 25*b* and the uppermost sheet 3*a*, as indicated by arrows in FIG. 3C. Due to the electrostatic attraction, the uppermost sheet 3*a* is electrostatically attracted to the over side of the electrostatic attraction belt 20.

Since the comb teeth electrode patterns 24*b* and 25*b* charged to the positive charge and the negative charge, respectively, are arranged to be disposed alternately in the lateral direction of the electrostatic attraction belt 20, a positive charge and a negative charge alternately appear on the surface of the uppermost sheet 3*a* in the lateral direction of the electrostatic attraction belt 20. Accordingly, a component of a repulsive force in the lateral direction of the electrostatic attraction belt 20 generated between the electrostatic attraction belt 20 and the sheet 3*a* by the charge of the same polarity is exerted in opposite directions alternately. As a result, once the uppermost sheet 3*a* is electrostatically attracted to the electrostatic attraction belt 20, the uppermost sheet 3*a* stays at the position without being shifted.

As described above, while attracting the uppermost sheet 3*a* to the over side of the electrostatic attraction belt 20, the electrostatic attraction belt 20 is moved in a direction indicated by arrow A in FIG. 1 by rotation of the drive roller 11 driven by the roller drive unit 13. By so doing, the uppermost sheet 3*a* can be conveyed precisely without causing lift or misregistration thereof.

With reference to FIGS. 3A through 3C, the electrostatic attraction belt 20 is manufactured by forming the electrode patterns 24*a* through 24*c* and 25*a* through 25 on the core layer 21, then forming the conductive members 24*d* and 25*d* that go through the core layer 21, covering the electrode patterns 24*a* through 24*c* and 25*a* through 25 by the cover layers 22 and 23 including a dielectric material, and connecting both edge portions thereof to make the electrostatic attraction belt 20 an endless belt. Any electrode pattern formed at the edge portions is separated. Therefore, the edge portions are designed to be the region of no attraction NR.

When the electrostatic attraction belt 20 including the region of no attraction NR as described above is employed to attract the uppermost sheet 3*a* electrostatically, if the uppermost sheet 3*a* is in contact with the region of no attraction NR during sheet attraction, a sufficient amount of force cannot be obtained, which may cause no feeding.

The sheet separation/conveyance device 10 according to the present embodiment includes the electrode set for charging 31 having a shape that can convey every sheet reliably.

A detailed description is given of the shape and position of the electrode set for charging 31 with reference to FIG. 4.

The electrode set for charging 31 provided in the sheet separation/conveyance device 10 according to the present embodiment includes two electrodes 31*a* and 31*b*. As illustrated in FIG. 4, the electrodes 31*a* and 31*b* are disposed facing each other at respective edge portions in the lateral direction of the electrostatic attraction belt 20.

Each of the electrodes 31*a* and 31*b* is formed in a substantially W shape when seen from the lateral direction of the electrostatic attraction belt 20. Specifically, the electrodes 31*a* and 31*b* are disposed to contact the electrostatic attraction belt 20 at two separate positions in the moving direction of the electrostatic attraction belt 20, which is the sheet conveying direction of the uppermost sheet 3*a* as illustrated in FIG. 1.

The electrode 31*a* includes two contact portions C1 and C2 and one non-contact portion NC, which are formed integrally. The contact portions C1 and C2 are two conductors contacting the electrostatic attraction belt 20. The non-contact portion NC is an insulator that isolates the contact portions C1 and C2 from each other.

The electrode 31*b* forms a conductor including the contact portions C1 and C2 to contact the electrostatic attraction belt 20.

The contact portions C1 and C2 of each of the electrodes 31*a* and 31*b* contact the electrode patterns 24*c* and 25*c* exposed from the slot 26. As a result, an appropriate high voltage can be applied to the lateral line electrode patterns 24*a* and 25*a* and the comb teeth electrode patterns 24*b* and 25*b* on the over side of the electrostatic attraction belt 20.

The reason why each of the electrodes 31*a* and 31*b* includes two contact portions C1 and C2 is described below. In a case where there is one contact portion is provided for the electrodes 31*a* and 31*b* and the electrostatic attraction belt 20, when the contact portion contacts the region of no attraction NR while the electrostatic attraction belt 20 is moving, it is likely to charge the electrostatic attraction belt 20 sufficiently. Further, as described below, the change of charged condition on the over side of the electrostatic attraction belt 20 cannot be detected reliably, as described below.

In the present embodiment, each of the electrodes 31*a* and 31*b* includes two contact portions C1 and C2. Therefore, even when a first contact portion that corresponds to the contact portion C1 of each of the electrodes 31*a* and 31*b* contacts the region of no attraction NR, a second contact portion that corresponds to the contact portion C2 of each of the electrodes 31*a* and 31*b* contacts the region of attraction AR. By so doing, the electrostatic attraction belt 20 can be sufficiently charged via the second contact portion.

Accordingly, each of the electrodes 31*a* and 31*b* is preferably formed to have a distance between the two contact portions C1 and C2 greater than a length of the region of no attraction NR.

Further, in the present embodiment, when one of the two contact portions C1 and C2 contacts the region of no attraction NR, the charged condition detector 33 detects the change of charged condition on the over side of the electrostatic attraction belt 20, thereby specifying the position of the region of no attraction NR. Accordingly, by controlling not to contact the uppermost sheet 3*a* when the specified region of no attraction NR is attracting the uppermost sheet 3*a*, no feeding can be prevented.

Next, a description is given of how to detect a charged condition on the electrostatic attraction belt 20 using electrodes 31*a* and 31*b*.

[Method of Detecting a Charged Condition on the Electrostatic Attraction Belt by Using a Voltmeter]

Figure 5:
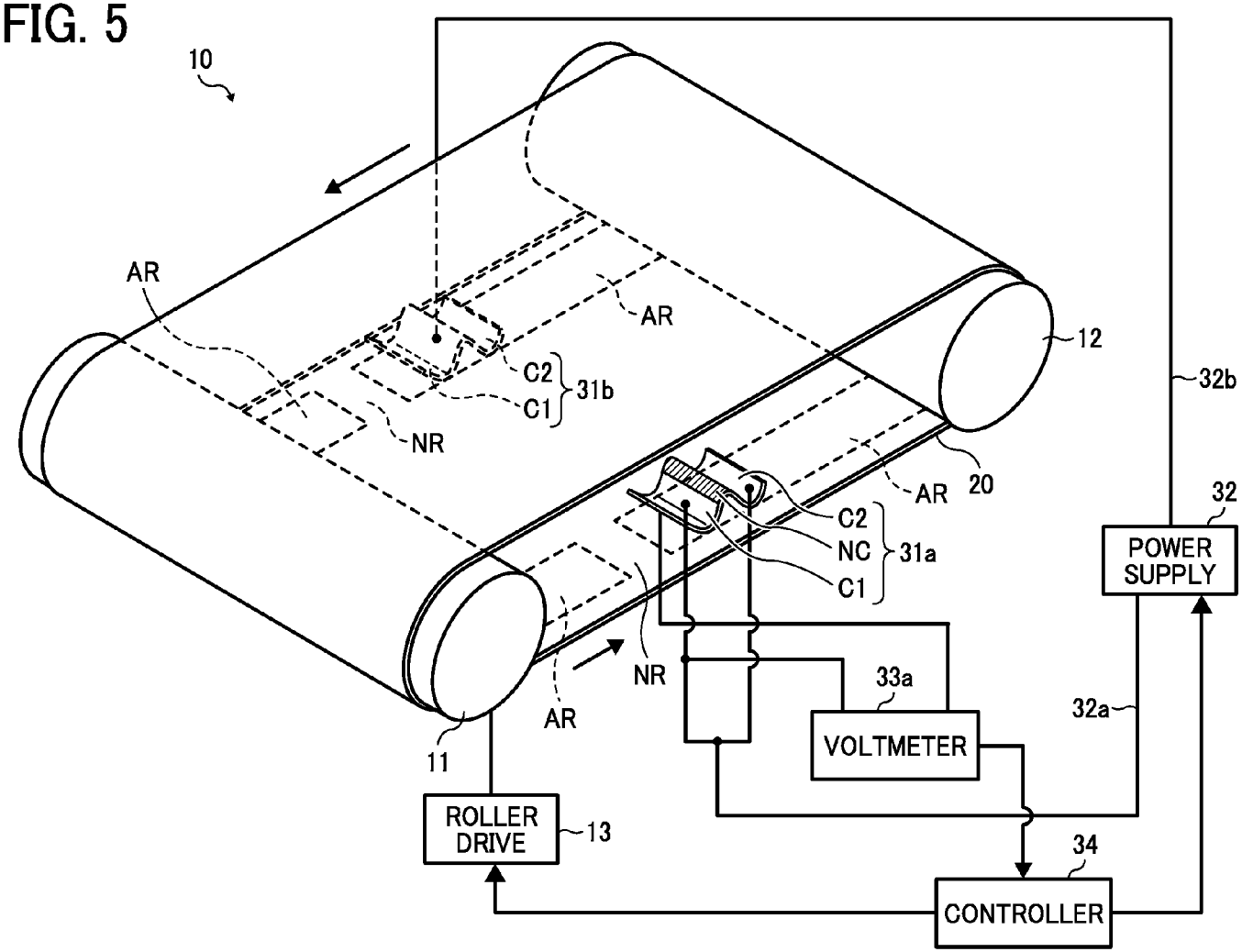
FIG. 5 is a diagram illustrating a circuit connection configuration according to an example to detect a charged condition of the belt using the electrode set for charging.

FIG. 5 is a diagram illustrating an example of a circuit connection configuration according to an example to detect a charged condition of the electrostatic attraction belt 20. The charged condition detector 33 of the charger 30 in the circuit connection configuration of FIG. 5 is a voltmeter 33*a*.

As illustrated in FIG. 5, the two electrodes 31*a* and 31*b* are connected to each other to apply a DC high voltage by the power supply 32. Specifically, the electrode 31*a* having the two conductors C1 and C2 divided by the insulator NC is connected to a negative feeder 32*a* of the power supply 32 and the electrode 31*b* is connected to a positive feeder 32*b* of the power supply 32.

With this configuration, the negative charge is applied to the longitudinal line electrode pattern 25*c* on the electrostatic attraction belt 20 to which the contact portions C1 and C2 of the electrode 31*a* and the positive charge is applied to the longitudinal line electrode pattern 24*c* on the electrostatic attraction belt 20 to which the contact portions C1 and C2 of the electrode 31*b*.

The voltmeter 33*a* is connected in parallel to the contact portion C1 of the electrode 31*a* having two conductors. In addition, a voltage value that is measured by the voltmeter 33*a*, which is data indicating the charged condition on the over side of the electrostatic attraction belt 20 detected when the electrode 31*a* contacts the electrostatic attraction belt 20, is sent to the CPU of the controller 34. The CPU of the controller 34 controls the power supply 32 and the roller drive unit 13 based on the data.

Figure 6A:
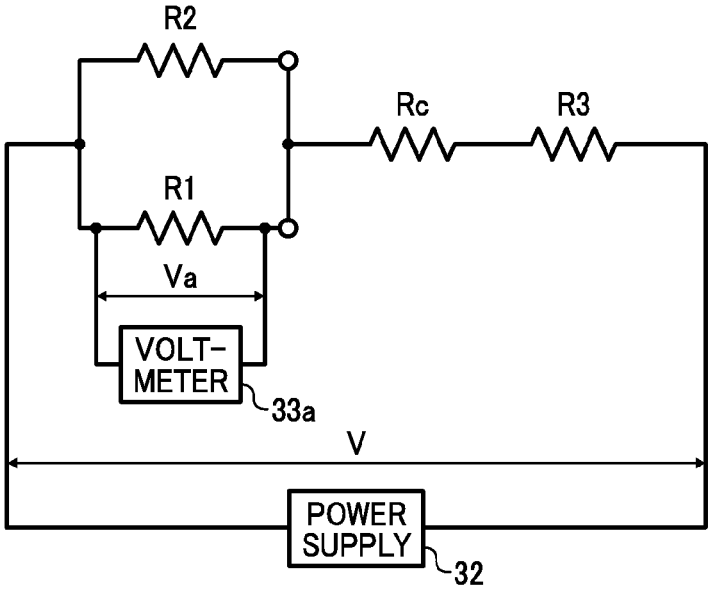
FIG. 6A is a diagram illustrating an equivalent circuit of the circuit connection configuration of FIG. 5 when a contact portion is a region of attraction.
Figure 6B:
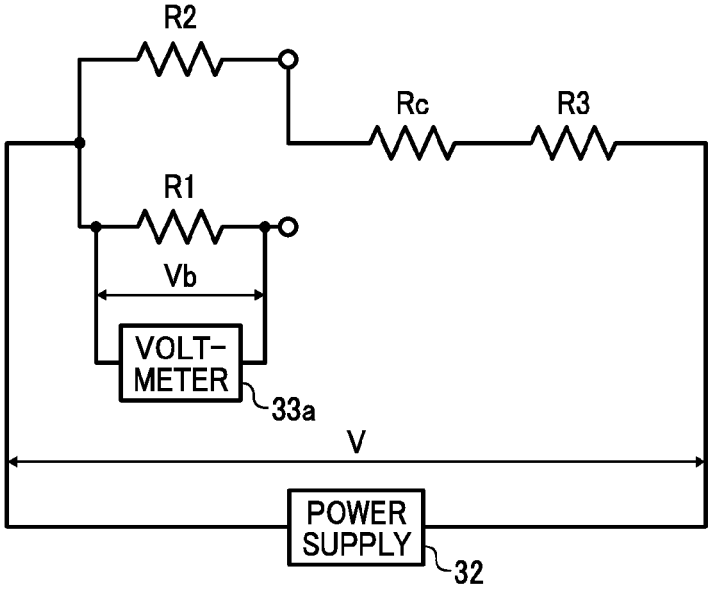
FIG. 6B is a diagram illustrating an equivalent circuit of the circuit connection configuration of FIG. 5 when a contact portion is a region of no attraction.

FIGS. 6A and 6B illustrate equivalent circuits of this circuit connection configuration. FIG. 6A illustrates an equivalent circuit of the circuit connection configuration when the contact portion is the region of attraction AR. FIG. 6B illustrates an equivalent circuit of the circuit connection configuration when the contact portion is the region of no attraction NR.

A voltage of the power source 3 is represented as "V", a resistance of the electrostatic attraction belt 20 is represented as "Rc", respective resistances of the contact portions C1 and C2 of the electrode 31*a* are represented as "R1" and "R2", and a resistance of the electrode 31*b* is represented as "R3".

As illustrated in FIG. 5, while both electrodes 31*a* and 31*b* contact the region of attraction AR of the electrostatic attraction belt 20, the voltage is applied to the entire circuit as illustrated in FIG. 6A. Accordingly, the voltmeter 33*a* is applied with the voltage obtained by an equation, which is $Va=V\cdot R1\cdot R2/\{R1\cdot R2/(R1+R2)(Rc+R3)\}$.

However, when the contact portion C1 of the electrode 31*a* contacts the region of no attraction NR of the electrostatic attraction belt 20, the electric current is not supplied to the resistance R1 as illustrated in FIG. 6B. Therefore, the voltage of the voltmeter 33*a* is Vb=0.

Figure 7:
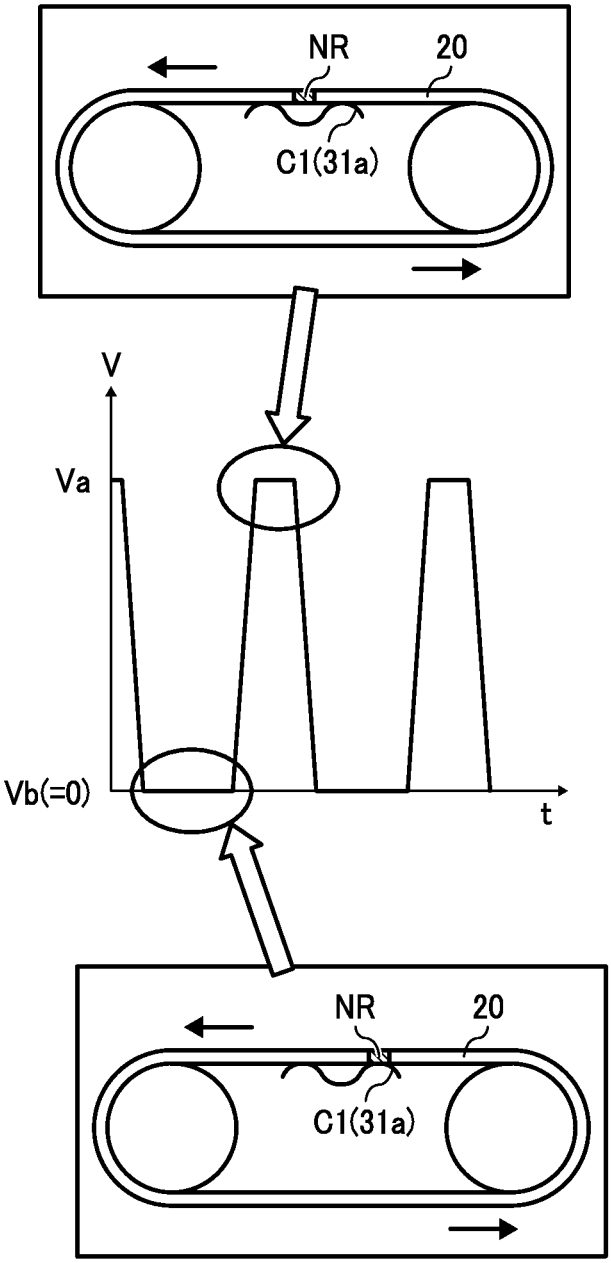
FIG. 7 is a diagram illustrating details of the circuit connection configurations of FIGS. 5, 6A, and 6B.

In detection of the charged condition on the electrostatic attraction belt 20, when the CPU of the controller 34 receives a stop signal of the electrostatic attraction belt 20, the controller 34 reads a first change, Vb (=0)→Va, as illustrated in FIG. 7 and stops the electrostatic attraction belt 20 and the power supply 32. Consequently, the region of no attraction NR of the electrostatic attraction belt 20 stops in the vicinity of the electrode 31*a*, so that the region of no attraction NR does not overlap a sheet attraction surface that is opposite to the surface on which the electrode 31*a* is disposed.

Specifically, the voltmeter 33*a* detects the change of the charged condition on the over side of the electrostatic attraction belt 20 (in this case, the change of the voltage value) when the electrode 31*a* contacts the electrostatic attraction belt 20. Based on the detection result of the change, the controller 34 controls the roller drive unit 13 of the sheet conveying unit 202 so that the region of no attraction NR of the electrostatic attraction belt 20 does not face and contact the uppermost sheet 3*a* while the uppermost sheet 3*a* is being attracted to the electrostatic attraction belt 20.

[Method of Detecting a Charged Condition on the Electrostatic Attraction Belt by Using a Galvanometer or an Ammeter]

Figure 8:
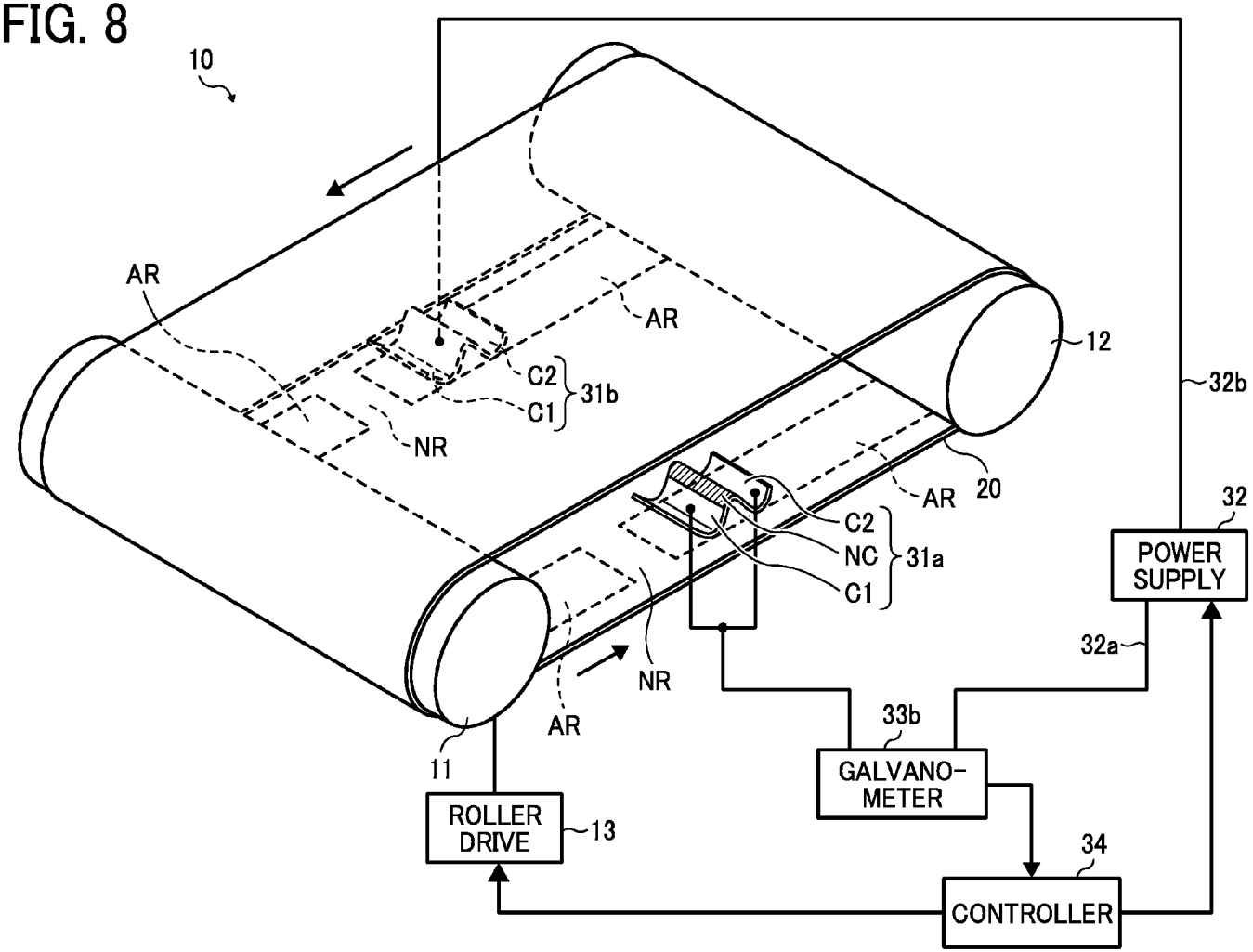
FIG. 8 is a diagram illustrating a circuit connection configuration according to another example to detect a charged condition of the belt using the electrode set for charging.

FIG. 8 is a diagram illustrating an example of a circuit connection configuration according to another example to detect a charged condition of the electrostatic attraction belt 20. The charged condition detector 33 in the circuit connection configuration of FIG. 8 is a galvanometer 33*b*.

As illustrated in FIG. 8, the galvanometer 33*b* is connected in series between the electrode 31*a* and the feeder 32*a* of the power supply 32. Since the other components and units in the circuit connection configuration are the same as those in the circuit connection configuration in FIG. 5, a detailed description thereof is omitted.

Figure 9A:
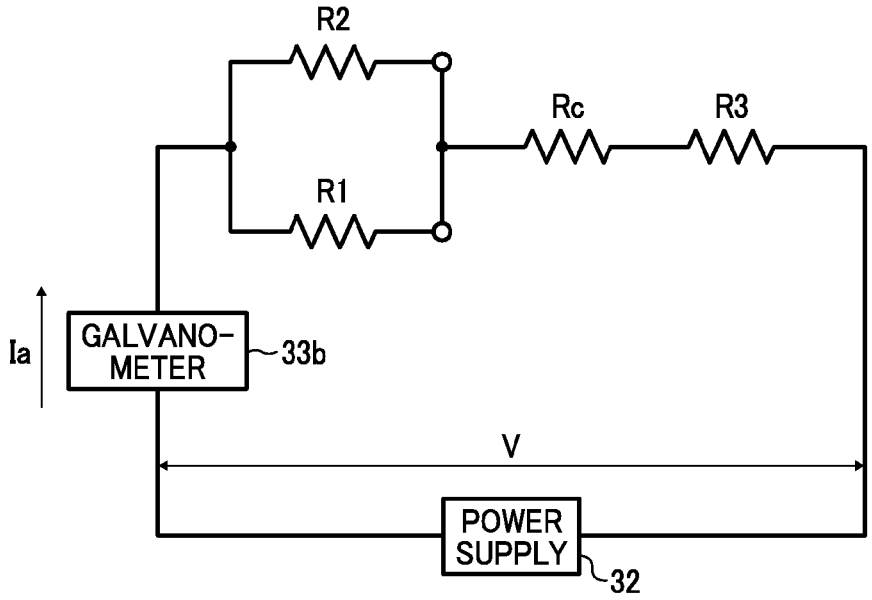
FIG. 9A is a diagram illustrating an equivalent circuit of the circuit connection configuration of FIG. 8 when a contact portion is a region of attraction.
Figure 9B:
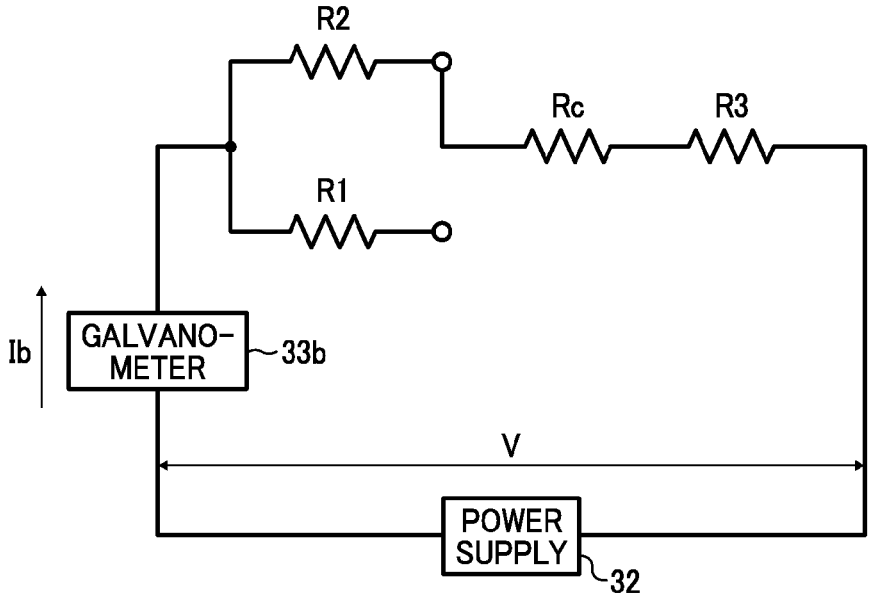
FIG. 9B is a diagram illustrating an equivalent circuit of the circuit connection configuration of FIG. 8 when a contact portion is a region of no attraction.

FIGS. 9A and 9B illustrate equivalent circuits of this circuit connection configuration. FIG. 9A illustrates an equivalent circuit of the circuit connection configuration when the contact portion is the region of attraction AR. FIG. 9B illustrates an equivalent circuit of the circuit connection configuration when the contact portion is the region of no attraction NR.

As illustrated in FIG. 8, while both electrodes 31*a* and 31*b* contact the region of attraction AR of the electrostatic attraction belt 20, the electric current is applied to the entire circuit as illustrated in FIG. 9A. Accordingly, the galvanometer 33*b* is applied with the electric current obtained by an equation, which is $Ia=V/\{R1\cdot R2/(R1+R2)+Rc+R3\}$.

However, when the contact portion C1 of the electrode 31*a* contacts the region of no attraction NR of the electrostatic attraction belt 20, the electric current is not supplied to the resistance R1 as illustrated in FIG. 9B. Therefore, the electric current of the galvanometer 33*b* is $Ib=V/(R1+Rc+R3)$.

Figure 10:
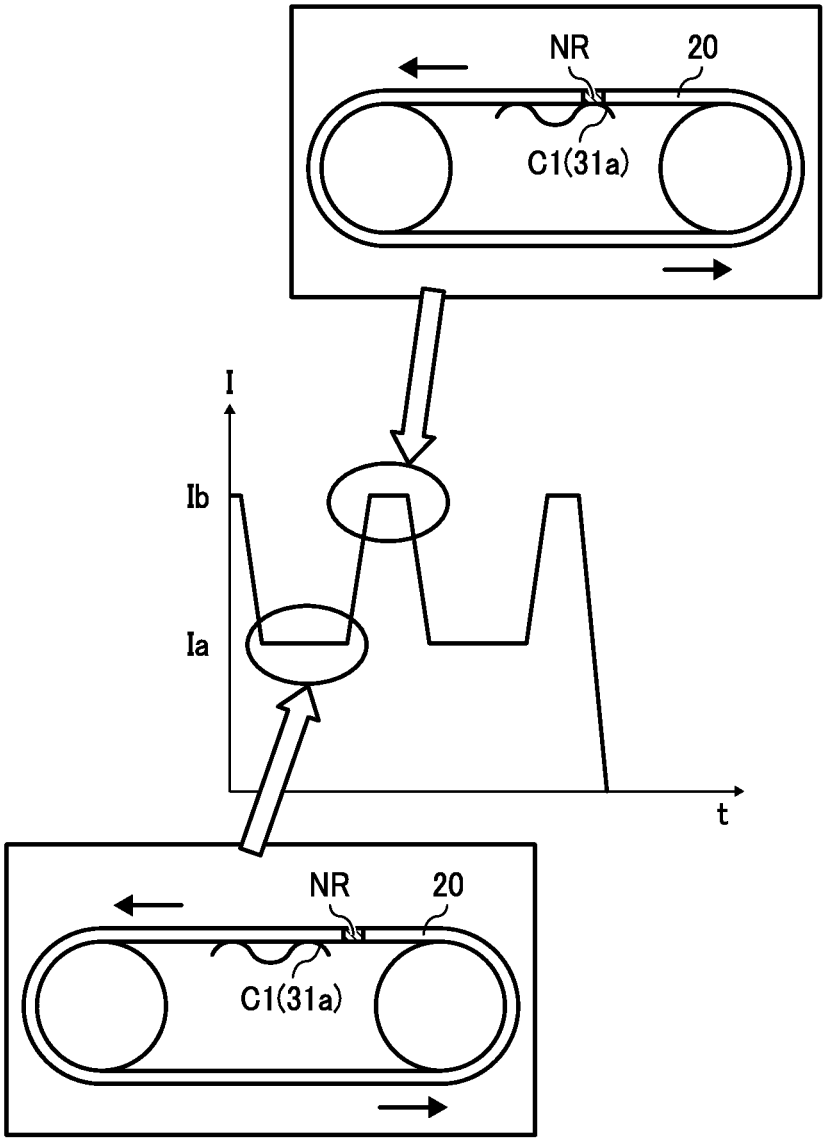
FIG. 10 is a diagram illustrating details of the circuit connection configurations of FIGS. 8, 9A, and 9B.

In detection of the charged condition on the electrostatic attraction belt 20, when the CPU of the controller 34 receives the stop signal of the electrostatic attraction belt 20, the controller 34 reads a first change, Ia→Ib, as illustrated in FIG. 10. The controller 34 then stops the electrostatic attraction belt 20 and the power supply 32. Consequently, the region of no attraction NR of the electrostatic attraction belt 20 stops in the vicinity of the electrode 31*a*, so that the region of no attraction NR does not overlap the sheet attraction surface that is opposite to the surface on which the electrode 31*a* is disposed.

Specifically, the galvanometer 33*b* detects the change of the charged condition on the over side of the electrostatic attraction belt 20 (in this case, the change of the electric current value) when the electrode 31*a* contacts the electrostatic attraction belt 20. Based on the detection result of the change, the controller 34 controls the roller drive unit 13 of the sheet conveying unit 202 so that the region of no attraction NR of the electrostatic attraction belt 20 does not face and contact the uppermost sheet 3*a* when the uppermost sheet 3*a* is being attracted to the electrostatic attraction belt 20.

In the present embodiment shown in FIGS. 8 through 10, the galvanometer 33*b* is used as an example of the charged condition detector 33 but not limited thereto. For example, an ammeter can be replaced with the galvanometer 33*b*.

As described above, in the sheet separation/conveyance device 10 according to the present embodiment, the charger 30 of the electrostatic attraction belt 20 includes the charged condition detector 33 to detect the charged condition of the over side of the electrostatic attraction belt 20 when the electrode set for charging 31 (i.e., the electrodes 31*a* and 31*b*) contacts the electrostatic attraction belt 20. Therefore, there is no need to provide a measuring instrument such as a surface potential meter around the electrostatic attraction belt 20.

As a result, the occupied space around the electrostatic attraction belt 20 can be reduced and no measuring instrument needs to be provided, thereby enhancing a reduction in cost.

Further, in the present embodiment, when one of the contact portions C1 and C2 of the electrode 31*a* contacts the region of no attraction NR of the electrostatic attraction belt 20, the charged condition detector 33 such as the voltmeter 33*a* detects the change of the charged condition (e.g., the voltage value) on the over side of the electrostatic attraction belt 20. According to this action, the position of the region of no attraction NR can be specified.

As a result, the controller 34 can control the roller drive unit 13 of the sheet conveying unit 202 so that the specified region of no attraction NR does not contact the uppermost sheet 3*a* during the attraction of the uppermost sheet 3*a*, thereby conveying the uppermost sheet 3*a* without causing no feeding.

The present embodiment shows an example that each of the electrodes 31*a* and 31*b* on the over side of the electrostatic attraction belt 20 includes two contact portions, which are the contact portions C1 and C2 but is not limited thereto. As long as the contact portions of each electrode are separated with a predetermined interval, which is a distance greater than a length of the region of no attraction NR, in the moving direction of the electrostatic attraction belt 20 (the sheet conveying direction), each electrode can include three or more contact portions.

Further, the present embodiment shows an example that the electrodes 31 (i.e., the electrodes 31*a* and 31*b*) are arranged on the under side (the inner circumferential surface) of the electrostatic attraction belt 20 but is not limited thereto. For example, the electrode set for charging 31 can be disposed on the over side (the outer circumferential surface) of the electrostatic attraction belt 20, which is opposite to the under side thereof and to which the uppermost sheet 3*a* is attracted.

In a case in which the electrode set for charging 31 is arranged on the over side of the electrostatic attraction belt 20, the high voltage for charging the electrostatic attraction belt 20 is applied to the electrode patterns on the electrostatic attraction belt 20 via the electrode set for charging 31. Therefore, the electrode patterns on the electrostatic attraction belt 20 are formed on the over side and those on the under side are not requested. That is, since the electrode patterns are formed on one side of the core layer 21 of the electrostatic attraction belt 20, the manufacturing process of the electrostatic attraction belt 20 is simplified, thereby reducing the cost.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet separation/conveyance device comprising:

an attraction/separation unit including an endless belt on which a region of attraction and a region of no attraction that divides the region of attraction are aligned in a sheet conveying direction, the endless belt configured to hold an uppermost sheet placed on top of a sheet stack contained in an image forming apparatus by using electrostatic attraction;

a charger configured to charge a surface of the endless belt, the charger comprising:

a direct current power supply;

an electrode configured to contact the surface of the endless belt due to a supply of a voltage from the direct current power supply, thereby creating the electrostatic attraction; and a detector configured to detect a charged condition on the surface of the endless belt based on a detection result obtained when the electrode contacts the endless belt; and a sheet conveying unit configured to convey the uppermost sheet held by the electrostatic attraction;

wherein the detection result is one of a group consisting of a positive charge and a negative charge;

a controller configured to control the sheet conveying unit, wherein, based on a detection result obtained by the detector of a change of a charged condition of the surface of the endless belt when the at least one electrode contacts the endless belt, the controller controls the sheet conveying unit so that the region of no attraction of the endless belt does not face the sheet while the uppermost sheet is being attracted to the endless belt.

2. The sheet separation/conveyance device according to claim 1, wherein the charger includes multiple electrodes, wherein at least one electrode of the multiple electrodes integrally includes two conductors disposed separately from each other in the sheet conveying direction in contact with the endless belt and an insulator to isolate the two conductors.

3. The sheet separation/conveyance device according to claim 1, wherein the electrode of the charger is disposed on an under side of the endless belt, which is an opposite side of the endless belt to which the uppermost sheet is attracted.

4. The sheet separation/conveyance device according to claim 1, wherein the detector is one of a group consisting of, a measuring instrument, a voltmeter, a galvanometer, and an ammeter, implemented on a substrate provided in the image forming apparatus.

5. An image forming apparatus comprising:

an image forming device configured to form an image on a surface of an image carrier; and the sheet separation/conveyance device according to claim 1.

6. An image forming apparatus comprising, an attraction/ separation unit including an endless belt on which a region of attraction and a region of no attraction that divides the region of attraction are aligned in a sheet conveying direction, the endless belt configured to hold an uppermost sheet placed on top of a sheet stack contained in an image forming apparatus by using electrostatic attraction;

a charger configured to charge a surface of the endless belt, the charger comprising:

a direct current power supply;

a controller configured to control the sheet conveying unit;

an electrode configured to contact the surface of the endless belt due to a supply of a voltage from the direct current power supply, thereby creating the electrostatic attraction; and a detector configured to detect a charged condition on the surface of the endless belt based on a detection result obtained when the electrode contacts the endless belt; and a sheet conveying unit configured to convey the uppermost sheet held by the electrostatic attraction, wherein the detection result is one of a group consisting of a positive charge and a negative charge, and wherein, based on a detection result obtained by the detector of a change of a charged condition of the surface of the endless belt when the at least one electrode contacts the endless belt, the controller controls the sheet conveying unit so that the region of no attraction of the endless belt does not face the sheet while the uppermost sheet is being attracted to the endless belt.

* * * * *